US005439358A

United States Patent [19]

Weinbrecht

[11] Patent Number: 5,439,358

[45] Date of Patent: Aug. 8, 1995

[54] RECIRCULATING ROTARY GAS COMPRESSOR

[76] Inventor: John F. Weinbrecht, 601 Oakwood Pl., NE., Albuquerque, N. Mex. 87123-2203

[21] Appl. No.: 187,145

[22] Filed: Jan. 27, 1994

[51] Int. Cl.[6] ..... F04C 18/18; F04C 29/04

[52] U.S. Cl. ..... 418/15; 418/83; 418/180; 418/206

[58] Field of Search ..... 418/15, 83, 86, 180, 418/205, 206

[56] References Cited

U.S. PATENT DOCUMENTS

| | | | |
|---|---|---|---|
| 4,215,977 | 8/1980 | Weatherston | 418/180 |
| 4,859,158 | 8/1989 | Weinbrecht | 418/15 |
| 5,090,879 | 2/1992 | Weinbrecht | 418/15 |

FOREIGN PATENT DOCUMENTS

| | | | |
|---|---|---|---|
| 76375 | 8/1961 | France | 418/206 |
| 1-32085 | 2/1989 | Japan | 418/15 |
| 622873 | 5/1949 | United Kingdom | 418/206 |
| 1675582 | 9/1991 | U.S.S.R. | 418/206 |

*Primary Examiner*—John J. Vrablik
*Attorney, Agent, or Firm*—William A. Eklund

[57] ABSTRACT

A positive displacement, recirculating Roots-type rotary gas compressor which operates on the basis of flow work compression is disclosed. The compressor includes a pair of large diameter recirculation conduits (30 and 32) which return compressed discharge gas to the compressor housing (16), where it is mixed with low pressure inlet gas, thereby minimizing adiabatic heating of the gas. The compressor includes a pair of involutely lobed impellers (12 and 14) and an associated port configuration which together result in uninterrupted flow of recirculation gas. The large diameter recirculation conduits equalize and accelerate gas flow velocities within the compressor and minimize gas flow losses. The compressor is particularly suited to applications requiring sustained operation at higher gas compression ratios than have previously been feasible with rotary pumps, for example continuous pumping of natural gas in gas transmission facilities.

9 Claims, 2 Drawing Sheets

RECIRCULATING ROTARY GAS COMPRESSOR

BACKGROUND OF THE INVENTION

1. Field of the Invention

The present invention is generally related to gas pumps and compressors. More particularly, the present invention is related to positive displacement rotary compressors, particularly including those known as Roots blowers and compressors, and to such compressors in such applications as refrigeration, condensation and natural gas transmission.

In particular, the present invention is related to, and constitutes an improvement over, the rotary gas compressors disclosed in the applicant's previously issued U.S. Pat. Nos. 4,859,158 and 5,090,879, issued Aug. 22, 1989 and Feb. 25, 1992, respectively.

2. Description Of Related Art Including Information Disclosed Under 37 CFR 1.97–1.99

The class of positive displacement gas compressors known as Roots compressors, or Roots blowers, has been known and used in industry for over a hundred years. It is well recognized in industry that for certain applications Roots compressors offer a number of advantages over other types of gas pumps and compressors, for example conventional piston-and-cylinder reciprocating pumps, fan-type blowers and turbine pumps. Among these advantages are simplicity, ruggedness, trouble-free operation, and high volumetric capacity. Roots compressors have no valves, pistons or other reciprocating mechanical parts. Additionally, Roots compressors have little or no backflow, even when the compressor is not operating. A typical application of a Roots compressor is the transfer or evacuation of large amounts of toxic or corrosive gas, where it is important to rapidly pump large amounts of gas with little or no backflow. In this type of application reciprocating pumps are relatively inefficient, and fan-type blowers and turbine pumps cannot provide a seal against backflow.

Roots compressors most commonly include two lobed impellers, sometimes also called rotors, which intermesh with one another and rotate in opposite directions in synchronization within a housing. The impellers operate to sweep a gas through the housing from an intake manifold at one end of the housing to an output manifold at the opposite end of the housing. Commercially available Roots compressors most commonly include impellers having only two lobes. However, Roots compressors have also been designed to include impellers having three, four and even more lobes. Two-lobed impellers are the most common, however, for several reasons. One reason is that they are simpler to construct and maintain. Also, they are characterized by a relatively higher volumetric efficiency. This high efficiency is due to the fact that the volumetric efficiency of a Roots compressor is generally inversely proportional to the proportion of the compressor chamber that is occupied by the impellers; and two-lobed impellers generally occupy a smaller volume than impellers having more lobes.

Roots compressors are extraordinarily efficient for the purpose of rapidly moving large volumes of gas where there is a relatively small pressure gradient across the compressor. Roots compressors have not heretofore been of useful application for the purpose of pumping a gas against a substantial pressure differential. This limitation has been due to heating effects which attend such pumping. As a gas is swept through a conventional Roots compressor from a region of relatively low pressure to a region of relatively higher pressure, it is compressed and heated. Such compression is essentially adiabatic, such that the temperature of the gas increases exponentially with increasing pressure ratios. The increase in the temperature of the gas leads to heating of the impellers, the housing and the other mechanical parts of the pump. This in turn can lead to thermal distortion, expansion and friction. At pressure ratios of greater than about two to one (2:1) such effects become a significant problem and essentially limit the sustained capacity of the compressor. Overheating of the compressor can result in lockup or other mechanical failure of the impellers, seals and other compressor components.

This heating problem is not uniform throughout the compressor. The compressor housing, for example, can be externally cooled by a number of conventional methods, such as the use of integral double-walled water jackets, heat radiating fins, heat sinks, and the like. The greatest heating problem however lies with the impellers, because there is no practical way to directly cool the impellers. Overheating of the impellers leads to their expansion and eventual binding against the housing, possibly causing extensive damage to the compressor. Overheating of the Roots compressor has thus been one of the major limitations on the use of Roots compressors for pumping gas against high pressure differentials, and for this reason commercially available Roots compressors are typically limited to pressure ratios of less than about four to one (4:1).

Perhaps the most simple and straightforward method of avoiding the adverse effects of overheating is to increase the clearances between the impellers and the housing, thereby allowing the impellers to expand somewhat on heating without rubbing and locking up against the housing. This however necessarily leads to increased gas leakage and backflow, and thereby degrades the volumetric efficiency of the compressor. For this reason, this approach has not generally been considered a satisfactory solution to the overheating problem.

A substantial advance in the art was the development of recirculation cycles to effect a moderate reduction in the heating of Roots compressors. In a recirculating Roots compressor, a portion of the output gas, which is compressed to a higher pressure than the input gas, is recirculated back into the compressor so as to effectively increase the pressure of the gas passing through the compressor. In some recirculating compressors a portion of the output gas is cooled prior to being recirculated back into the compressor. In both cases the operating temperature of the compressor is effectively reduced, thereby mitigating the overheating problems referred to above.

U.S. Pat. No. 2,489,887 to Houghton, for example, discloses the general concept of cooling the impellers of a Roots compressor by introducing recirculated gas of a lower temperature into the intake gas to reduce heating of the impellers.

U.S. Pat. No. 3,351,227 to Weatherston discloses a multi-lobed Roots-type compressor having feedback passages which allow a portion of the high-pressure discharge gas to be recirculated back into the pump housing. Weatherston however discloses only the use of quite small feedback passages, the size of which are unrelated to the sizes of the intake and discharge ducts.

This results in uneven flow velocities and pressures. As will be apparent from the description of the present invention set forth below, this does not solve the flow problems addressed by the present invention.

German Patent 2,027,272 to Kruger discloses the concept of cooling and recirculating discharge gas in a two-lobed Roots compressor. The compressor of Kruger, due to its two-lobed configuration, has no provision for preventing backflow from the discharge port into the recirculation ports.

French Patent 778,361 to Bucher discloses four-lobed Roots compressors having recirculation ports. The recirculation ports are however small, with the intended purpose of using small nozzle-like ports being to allow the recirculated gas to adiabatically cool upon entry into the compressor housing. As Will be apparent from the description below, this teaching of Bucher is contrary to the present invention.

U.S. Pat. No. 4,453,901 to Zimmerly discloses a positive displacement rotary pump which is designed for pumping liquids, and which contains no provision for recirculation.

U.S. Pat. No. 4,390,331 to Nachtrieb discloses rotary compressor having four-lobed impellers, but likewise having no provision for recirculation.

U.S. Pat. No. 2,906,448 to Lorenz discloses a rotary positive displacement compressor having two-lobed impellers, with a double-walled construction for cooling purposes.

British Patent 282,752 to Kozousek discloses a rotary pump which is characterized by rotor lobes which are particularly shaped so as to provide the maximum possible working space and thereby maximize the volumetric efficiency of the pump. The pump disclosed in Kozousek discloses recirculation ports which are deliberately made small, and which are for the purpose of obtaining even delivery of gas.

Various kinds of Roots compressors are commercially available, both with and without recirculation. However, none of the commercially available compressors address the problems of recirculation flow impedance and flow velocity equalization which are addressed by the present invention.

In some prior art recirculating Roots compressors, such as the compressor described in Houghton, the flow of recirculating gas is either periodically interrupted each time a rotor lobe passes the recirculation entry port, or is halted and possibly even reversed as a displacement cavity is simultaneously opened to both a recirculation port and a discharge port. This results in a loss of momentum and flow of the recirculation fluid, reducing the efficiency of the recirculation fluid in cooling the compressor. This problem, which is inherent in many previously known Roots compressors, is overcome in the present invention, as will be made apparent by the descriptions set forth below.

In the applicant's previously issued U.S. patents, cited above, certain improvements were disclosed which achieved lower operating temperatures by recirculation of the working fluid. The present invention provides certain improvements in the compressors described in those Patents.

Accordingly, it is the object and purpose of the present invention to provide an improved positive displacement rotary gas compressor.

It is also an object and purpose of the present invention to provide a positive displacement rotary gas compressor having an improved gas recirculation means for reducing overheating of the compressor.

It is a further object and purpose of the present invention to provide a positive displacement rotary gas compressor which is characterized by having a continuous, uninterrupted flow of recirculation fluid which flows from the output of the compressor back into the compressor.

It is also an object and purpose of the present invention provide a positive displacement rotary gas compressor that produces less heat inside the compressor and is thus capable of operating at higher pressure ratios than have been previously available.

It is also an object of the present invention to provide a positive displacement rotary gas compressor that is particularly suited for use in combination with a vapor condenser, for example for compressing condensable gases as in a refrigeration apparatus.

It is yet another object of the present invention to provide a rotary gas compressor which utilizes flow work to achieve improved efficiency through substantially isothermal gas compression.

It is yet another object of the invention to attain the foregoing objects and also reduce acoustic noise emission from the compressor.

SUMMARY OF THE INVENTION

The present invention provides an improved positive displacement, recirculating rotary compressor characterized by inlet, discharge, and recirculation ports and conduits which are arranged so as to minimize flow impedance and equalize flow velocities, to thereby minimize flow losses and associated overheating of the compressor. For reasons which will be apparent from the following description, the present invention is also referred to herein as a flow work compressor.

The present invention integrates an open flow recirculation system, operating at output pressure, with a multi-lobed Roots type rotary compressor. The compressor feeds input pressure gas into a recirculation system at constant temperature through flow work. Power for the flow work is supplied by equivalent shaft work.

The compressor of the present invention includes a housing having mutually opposing cylindrically curved interior side walls, and having a gas inlet port located at one end of the housing between the cylindrically curved interior side walls. The compressor housing further includes a gas discharge outlet located at the opposite end of the housing from the inlet port, and also located between the cylindrically curved side walls, and which opens into a manifold that is connected to a gas discharge port. The compressor housing further includes first and second gas recirculation ports formed respectively in the cylindrically curved opposing side walls between the inlet port and the outlet port. The compressor further includes first and second recirculation conduits connecting in fluid communication the manifold with the first and second recirculation ports. The inlet port and the outlet port are approximately equal in size to one another, and the outlet port is approximately twice the size of each of the recirculation ports. The inlet, outlet and recirculation ports are isolated from direct fluid communication with one another and are sized as large as possible within the constraints of the foregoing relationships, The compressor further includes a pair of intermeshed, involutely lobed impellers which are rotatably journalled in the housing. The impellers are driven to rotate in opposite directions so as sweep a gas from the inlet port to the outlet port. The preferred embodiment includes a flow diverter between the inlet port and the impellers, which reduces backflow of gas and facilitates laminar flow of the incoming gas, while also attenuating acoustic noise generated at the intermeshing zone of the impellers.

The lobes of the impellers are shaped so as to not completely obstruct the recirculation ports, and thereby not momentarily interrupt the flow of recirculation gas as the impellers rotate past the recirculation ports. Additionally, the number of lobes of the impellers and the angular reach of the cylindrically curved interior housing side walls are related. More particularly, the angular sectors through which the wall surfaces extend, between each of the recirculation ports and the discharge port, and also between each of the recirculation ports and the inlet port, are preferably selected so as to be no greater than the angular relationship between adjacent lobes of the impellers.

The preferred embodiment also includes recirculation ports which each open into the housing at an acute angle with respect to the internal surfaces of the housing at the points where the recirculation ports open into the housing. This causes the incoming recirculating gas to enter the housing in a direction that approximates the direction of the rotating impeller tips. The preferred embodiment may also include recirculation conduits which taper downward in interior dimension from the manifold to the recirculation ports, such that the recirculating gas is accelerated along the recirculation conduits to a speed that is nearly as great as the circumferential speed of the tips of the impeller lobes.

It will be appreciated that this arrangement results in minimum flow impedance and a minimum of adiabatic heating of the gas being compressed by the compressor, while also ensuring that the inlet port, the recirculation ports, and the discharge port are at all times during operation isolated from one another by the impeller lobes so as to prevent backflow due to direct fluid communication between the ports.

In the preferred embodiment, the impellers are each provided with six lobes. Further, the opposing interior housing walls extend through angular sectors of approximately sixty (60) degrees between the proximal edges of the outlet port and the each of the recirculation ports; and extend through angular sectors of approximately one hundred and twenty (120) degrees between the proximal edges input port and the recirculation ports. This embodiment is preferred because it results in lower slippage, or backflow between the tips of the impeller lobes and the housing walls, and is thereby characterized by improved volumetric efficiency.

The compressor of the present invention may also include a heat exchangers located in the discharge manifold, by which the gas compressed in the compressor may be cooled by a suitable coolant fluid immediately upon being compressed and discharged into the manifold. This positioning of the heat exchanger results in cooling of the compressed gas before it is recirculated into the compressor, thereby obtaining optimum efficiency of cooling of the compressor with a minimum of adiabatic cooling.

The compressor of the present invention is believed to be useful in many applications requiring continuous compression of large volumes of gas. One exemplary application is the compression of natural gas in natural gas transmission and distribution systems.

These and other aspects of the present invention will be more apparent upon consideration of the more detailed description of the invention set forth below and the accompanying drawings.

BRIEF DESCRIPTION OF THE DRAWINGS

The accompanying drawings are incorporated into and form a part of this specification and, when taken in combination with the detailed description below, illustrate the operation and construction of the best mode of the invention known to the inventor.

In the Figures.

DESCRIPTION OF THE PREFERRED EMBODIMENT

Figure 1:
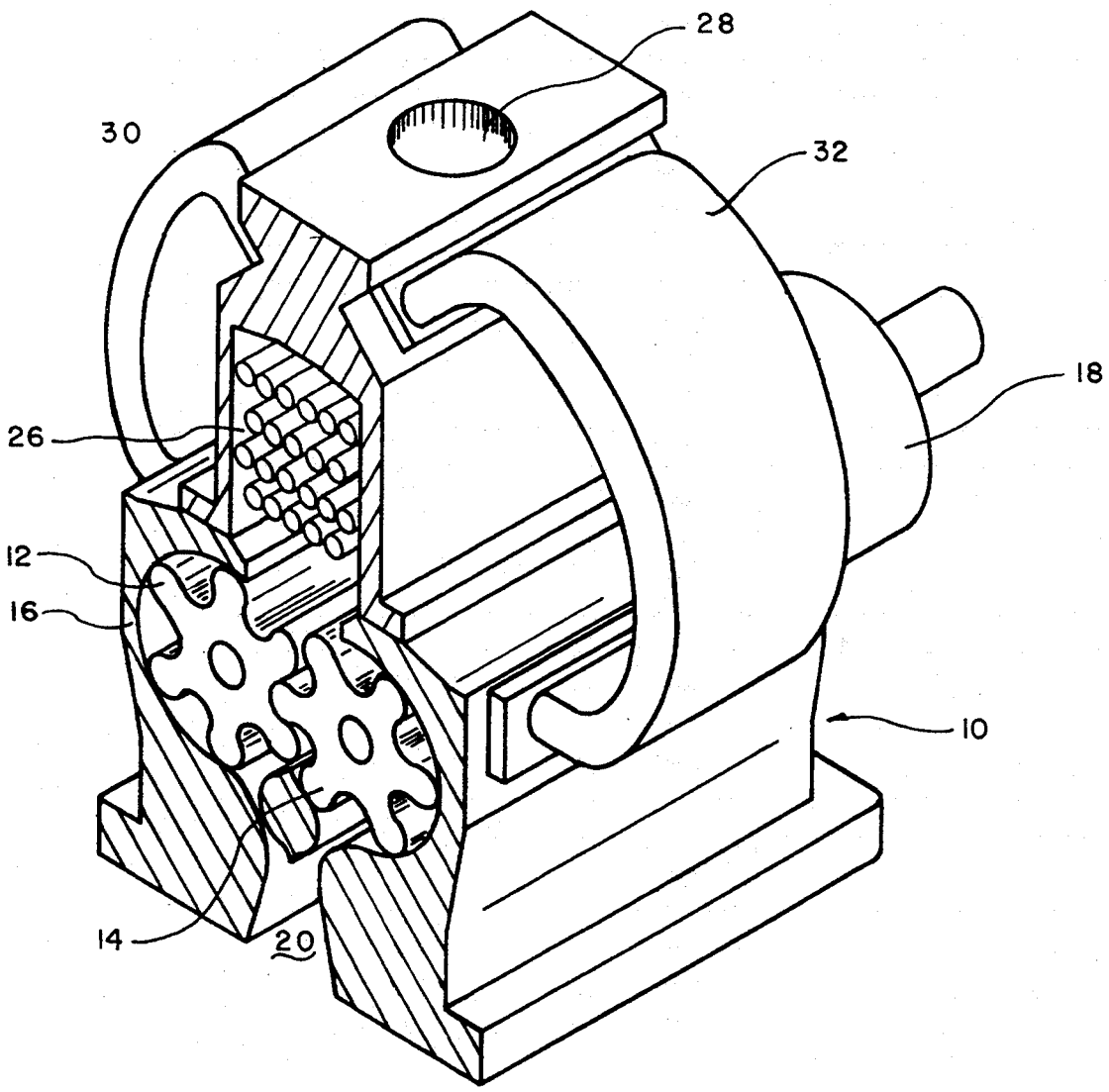
FIG. 1 is an end view in cross-section of the preferred embodiment of the rotary compressor of the present invention.
Figure 2:
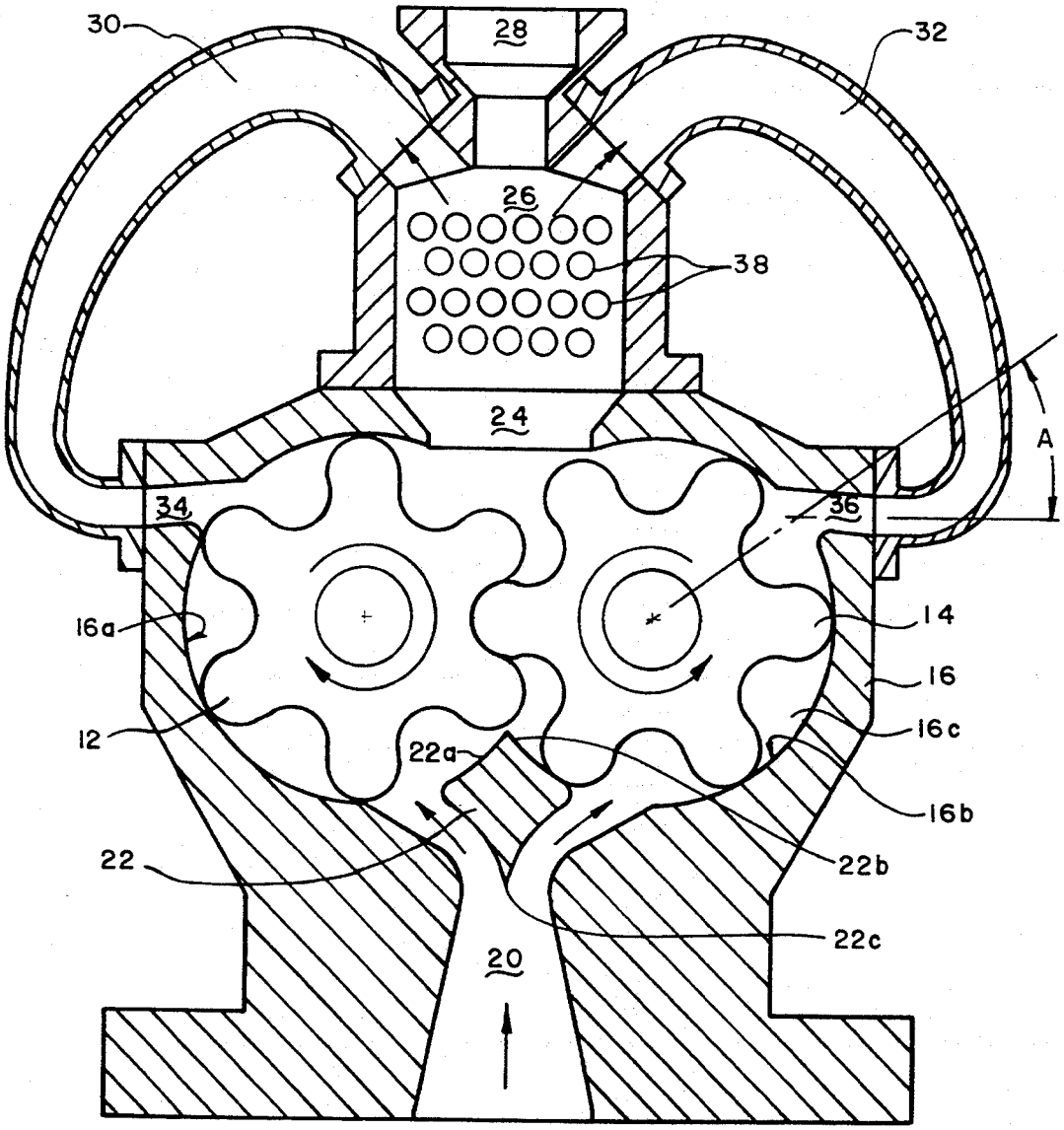
FIG. 2 is an isometric view of the rotary compressor of FIG. 1.

Referring to FIGS. 1 and 2, there is illustrated a preferred embodiment of the positive displacement, recirculating rotary compressor 10 of the present invention. The compressor includes two six-lobed impellers 12 and 14 which are rotatably mounted within a hollow housing 16. The housing 16 has an interior surface which includes two mutually opposing, cylindrically curved side walls **16*a* and 16*b*. The housing 16 further includes flat end walls, only one of which, 16*c*, is shown. Briefly, the diameters of the lobed impellers 12 and 14 correspond, to within a preferable tolerance of a few thousandths of an inch, the diameters of the cylindrically curved side walls 16*a* and 16*b*. The lobed impellers 12 and 14 are substantially identical to one another, and will therefore be described in greater detail at various points below primarily by reference to the details of construction and operation of the impeller 12, shown generally on the left-hand side of the Figures. The six lobes of each of the impellers 12 and 14** are substantially identical lobes to one another.

Briefly, the impellers 12 and 14 are driven by a motor 18 to rotate in opposite directions about parallel axes of rotation which extend along the central axes of the impellers 12 and 14. The axes of rotation of the impellers 12 and 14 are also colinear with the central longitudinal axes of the cylindrically curved interior walls **16*a* and 16*b*, respectively. The lobes of the impellers 12 and 14 have a maximum radius which is typically a few thousandths of an inch less than the geometric radius of the cylindrically curved side walls 16*a* and 16*b*. The impellers 12 and 14 are maintained in the proper angular relationship to one another, which is at an angular phase relationship of 30° with respect to one another, by their normal intermeshing relationship and also by means of timing gears (not shown) which are located outside the primary chamber of the housing 16**.

In operation, a gas is admitted to the compressor through a downwardly opening, flared gas inlet port 20 that is formed at the lower end of the housing 16 and which is generally centered between the side walls **16*a* and 16*b*. The admitted gas is split by a flow diverter 22 and is swept through the housing 16 by the impellers 12 and 14. The gas is swept by the lobes of the impellers 12 and 14 out of the housing 16 through a compressor housing gas outlet port 24 into a discharge manifold 26**.

From the discharge manifold 26, part of the gas is discharged through a discharge port 28 which opens upwardly from the manifold 26, and another part of the gas is recirculated back to the pump housing 16 through a pair of recirculation conduits 30 and 32. The recirculation conduits 30 and 32 connect the discharge manifold 26 to a pair of recirculation ports 34 and 36, respectively. The recirculation ports 34 and 36 open onto the cylindrically curved interior surfaces 16*a* and 16*b* of the housing 16. In particular, the recirculation ports 34 and 36 are positioned and oriented angularly so as to achieve optimum flow velocity and flow volume of the recirculated gas for the purposes of reducing adiabatic heating of the gas passing through the compressor housing 16. In the preferred embodiment the recirculation ports 34 and 36 are each oriented so that the gas entering the compressor housing 16 enters the housing at an acute angle with respect to the tangential surfaces of the interior walls 16*a* and 16*b* of the housing, with the acute angle being directed in the direction of travel of the impeller lobes. A preferred angle is approximately 55 degrees to 60 degrees from the direction normal to the housing surfaces 16*a* and 16*b* at the point of entry, as illustrated by angle A in FIG. 2.

It will also be noted that the recirculation conduits 30 and 32 taper downwardly from the manifold 26 to the recirculation ports 34 and 36, such that the recirculating gas is accelerated as it flows from the manifold 26 along the recirculation conduits 30 and 32 to the recirculation ports 30 and 32, attaining a speed of approximately 85 to 90 percent of the speed of the impeller lobe tips.

In rotation, the lobes of the impellers 12 and 14 intermesh in flush contact with one another, so that there is at all times a high-impedance clearance between the impellers, which clearance is small in comparison with the volumetric displacement of the compressor, and which essentially restrict, by sonic choking, backflow of high pressure discharge gas through the compressor.

The lobed impeller geometry results in continuous mesh contact between the impellers 12 and 14 throughout full rotation, such that backflow of the gas occurs only as a consequence of the tolerance, or play, between the impellers. The form of the individual lobes of the impellers 12 and 14 is involute between the tip and root radii.

Backflow of gas is also reduced by the flow diverter 22, which serves multiple functions. First, the diverter 22 functions as a fairing to split the incoming gas into two equal laminar flows and divert the flows into the two sides of the compressor housing 16, thereby reducing net flow impedance of the incoming gas. Secondly, as just stated, the diverter 22 functions to reduce backflow of compressed gas through the impellers 12 and 14. Finally, the flow diverter 22 provides a significant reduction in acoustic noise generated by the impellers 12 and 14.

With regard to the latter, it will be appreciated that, in the absence of the diverter 22, the acoustic noise normally generated in the zone of intermeshing between the impellers 12 and 14 will be primarily emitted from the compressor 10 through the inlet port 20, due to the proximity to the impellers to the inlet port and also due to their rotational travel in the direction of the inlet port at the point of intermeshing. As with all air compression equipment such as compressors, turbines, propellers and the like, this noise level can be both substantial and offensive. The noise level in the present invention is however substantially reduced by positioning the diverter 22 so that it is located between the zone of intermeshing and the inlet port 20.

Further in this regard, the diverter 22 includes cylindrically curved upper surfaces 22*a* and 22*b*, which function effectively as extensions of the cylindrically curved compressor housing walls 16*a* and 16*b*, respectively, and thereby also function in some capacity as gas seals to prevent backflow of pressurized gas through the intermeshing zone between the rotors 12 and 14. The lower side of the diverter 22 is tapered to an edge 22*c* and is aerodynamically configured to divide and divert the flow of incoming gas into equal laminar flows entering the opposite sides of the housing 16.

The recirculation ports 34 and 36 open into the housing 16 so as to function to recycle high-pressure discharge gas back into the compressor housing 16, thereby raising the gas pressure in the housing 16 while largely avoiding the heat gain that results from adiabatic mechanical compression within the compressor, and reducing the tendency of the compressor to overheat when the ratio of the intake gas pressure to the discharge gas pressure is high.

It will be understood that all of the ports, but particularly the inlet port 20, the outlet port 24, and the recirculation ports 34 and 36, may preferably be generally elongate in shape and extend parallel to the axes of the impellers 12 and 14, as illustrated in FIG. 1.

In the Figures the recirculation conduits 30 and 32 are shown as being external to the housing 16. It will also be understood however that the recirculation conduits 30 and 32 may be formed as integral elements of a cast compressor housing 16, and that economies of manufacture, size and maintenance may suggest such a mode of construction.

The compressor 10 may include heat exchangers 38, which are located in the manifold 26 and which are illustrated in the Figures as a simple multi-tube heat exchange assembly through which water or another suitable coolant fluid may be pumped. It will be appreciated that the advantage of utilizing the heat exchangers 38 in the discharge manifold 26 is that gas passing through the compressor 10 is cooled immediately upon being compressed and discharged into the discharge manifold 26, such that a portion of the cooled, compressed gas operates to cool the impellers 12 and 14 as the gas is recirculated into the cavity 16 through the recirculation conduits 30 and 32. That is, the compressor 10 is effectively cooled by direct internal cooling of the compressed gas and subsequent direct cooling of the impellers and the inside of the housing 16, as opposed to the more conventional approach of cooling of the compressor housing 16 from the outside, as by the use of external air cooling vanes or by fluid coolants circulated through integral cooling tubes formed in the housing 16.

The relatively high pressure ratio capability of the compressor of the present invention is a consequence of the fact that the pressure gain in the housing is largely a result of flow work, which results from optimizing the flow of recirculation gas, as opposed to adiabatic compression and associated heating. In this regard, with increasing gas pressure ratios flow work becomes asymptotic, whereas temperature increases due to adiabatic, or isentropic, compression are exponential.

It is believed that the compressor of the present invention will find utility in a wide variety of applications where high volume, sustained pumping is required at pressure ratios of up to approximately ten to one (10:1).

Inasmuch as Roots compressors have previously only been capable of sustained operation at pressure ratios of approximately four to one (4:1), due to limitations imposed by heating of the compressor components, the higher attainable pressure ratio capability of the present invention will make it useful in a wide variety of applications where the use of positive displacement rotary Roots compressors has not been previously considered feasible. These new applications are indeed useful because of the general advantages of positive displacement rotary pumps mentioned above; namely, simplicity, high volumetric efficiency, and the absence of rubbing or reciprocating mechanical components. Moreover, compressor units can be hermetically sealed, or can be sealed by the use of non-leakage shaft seals. This feature is a major consideration, for example, in the chemical processing industry; for gaseous laser discharge systems; for microchip processing vacuum systems; and for food industry freeze drying systems.

Additional reductions in compressor heating can be attained, as described above, by the incorporation of heat exchangers of various types into the manifold 26.

Further, as already noted the present invention has particularly useful application to large volume, continuous processing of gas, for example in natural gas transmission and distribution systems.

It will also be appreciated that the working fluid temperature throughout the compressor remains nearly constant. No significant waste heat is generated, and the problems and limitations associated with thermal distortion are avoided. This feature is not present in any previously available positive displacement compressor. The compressor provides an inherent energy efficiency advantage that improves with increasing compression ratio. The compressor is characterized by a nearly uniform working fluid temperature, which is a distinct advantage in many chemical processing applications.

Yet another advantage of the present invention is its quiet operation. Since there is no significant pressure pulse into the discharge gas, noise commonly generated at this point in other compressors is greatly reduced.

Although the present invention is described herein with reference to a preferred embodiment and an alternative embodiment, it will be understood that various modifications, substitutions and alterations, which may be apparent to one of ordinary skill in the art, may be made without departing from the essence of the invention. Accordingly, the present invention is defined by the following claims.

The embodiments of the invention in which patent protection is claimed are defined as follows:

1. A positive displacement recirculating rotary compressor comprising:

a housing having two mutually opposing cylindrically curved interior side walls; said housing including a gas inlet port at one end located between said mutually opposing cylindrically curved side walls and a gas outlet port located at the opposite end of said housing from said inlet port and also located between said mutually opposing cylindrically curved interior side walls; said gas outlet port opening into a discharge manifold having a gas discharge port;

said housing further including first and second gas recirculation ports formed respectively in said cylindrically curved opposing side walls between said inlet port and said outlet port;

first and second involutely lobed impellers journalled for rotation in opposite directions within said housing; each of said impellers having at least four lobes; said impellers being intermeshed so as to form a high-impedance seal when said impellers are rotated in opposite directions;

first and second recirculation conduits connecting said manifold with said first and second recirculation ports, said recirculation ports opening onto said interior walls of said housing at an acute angle with respect to said interior surface walls of said housing, whereby gas entering said housing through said recirculation ports enters in a direction approximating the direction of travel of said impellers;

said inlet port and said outlet port being approximately equal in size to one another; said outlet port being approximately twice the size of each of said recirculation ports; said inlet, said outlet and said recirculation ports being isolated from direct fluid communication with one another and further being as large as possible within the constraints of the foregoing size relationships;

whereby a portion of gas discharged from said housing through said outlet port is returned to said housing through said recirculation ports so as to reduce heating of said impellers; and with the sizing of said inlet, outlet and recirculation ports thereby resulting in minimal flow losses.

2. The positive displacement recirculating rotary compressor defined in claim 1 wherein each of said impellers has six lobes.

3. The positive displacement recirculating rotary compressor defined in claim 2 further comprising a flow diverter positioned within said housing between said inlet port and said impellers.

4. The positive displacement recirculating rotary compressor defined in claim 3 wherein said flow diverter includes cylindrically curved upper surfaces which form extensions of said cylindrically curved interior surfaces of said housing, said diverter functioning to divide and divert incoming gas into two flows while also attenuating acoustic noise generated by said impellers.

5. The positive displacement recirculating rotary compressor defined in claim 4 wherein said flow diverter includes a central downwardly extending edge which enables said diverter to operate as an aerodynamic fairing to divide incoming gas into two substantially equal laminar flows of gas.

6. The positive displacement recirculating rotary compressor defined in claim 1 wherein said recirculation ports are oriented such that gas entering said housing through said recirculation ports is directed at an angle of between approximately 50 degrees to 60 degrees from a direction radial to said cylindrically curved interior housing walls.

7. The positive displacement recirculating rotary compressor defined in claim 6 wherein said recirculation conduits are tapered downward from said discharge manifold to said recirculation ports, whereby gas recirculating through said conduits is accelerated to a speed approximately as great as the speed of said impellers.

8. The positive displacement recirculating rotary compressor defined in claim 7 wherein said recirculation ports are sized such that said gas recirculating through said conduits is accelerated to a speed of between approximately 85 and 90 percent of the speed of said impellers.

9. The positive displacement recirculating rotary compressor defined in claim 1 further comprising a heat exchanger positioned in said discharge manifold.

* * * * *